US007399133B1

(12) United States Patent
Eversole

(10) Patent No.: US 7,399,133 B1
(45) Date of Patent: Jul. 15, 2008

(54) SELF CONTAINED DISPOSABLE TOOTHBRUSH

(76) Inventor: Robert K. Eversole, 405 W. Third St., Madison, IN (US) 47250

( * ) Notice: Subject to any disclaimer, the term of this patent is extended or adjusted under 35 U.S.C. 154(b) by 328 days.

(21) Appl. No.: 11/276,333

(22) Filed: Feb. 24, 2006

(51) Int. Cl.
*A46B 11/00* (2006.01)

(52) U.S. Cl. ..... 401/123; 401/268; 401/175; 401/191; 401/281; 401/269; 401/134; 401/132; 132/311

(58) Field of Classification Search ..... 401/123, 401/268, 171–175, 181, 191, 282, 132–134, 401/183–185, 187, 291, 99; 132/311, 308; 222/390, 534
See application file for complete search history.

(56) References Cited

U.S. PATENT DOCUMENTS

| | | | | |
|---|---|---|---|---|
| 1,033,022 | A * | 7/1912 | Kress | 401/268 |
| 1,859,402 | A | 5/1932 | Maher | |
| 2,162,447 | A | 3/1939 | Seibel | |
| 2,199,922 | A | 5/1940 | Momanis et al. | |
| 2,807,818 | A | 10/1957 | Taylor | |
| 2,814,816 | A | 12/1957 | Pepping et al. | |
| 2,845,645 | A | 8/1958 | Wishnefsky et al. | |
| 2,900,650 | A | 8/1959 | Rivero | |
| 3,217,720 | A | 11/1965 | Cyzer | |
| 3,353,898 | A | 11/1967 | Lamberti | |
| 3,356,095 | A | 12/1967 | Tylle | |
| 3,400,996 | A | 9/1968 | Vandergrift | |
| 3,734,118 | A | 5/1973 | Howard | |
| 4,002,181 | A | 1/1977 | Rivera | |
| 4,155,663 | A | 5/1979 | Cerquozzi | |
| 4,467,822 | A | 8/1984 | Blackwell | |
| 4,482,263 | A | 11/1984 | Palamara | |
| 4,543,679 | A | 10/1985 | Rosofsky et al. | |
| 4,759,381 | A * | 7/1988 | Cesari | 401/175 |
| 4,886,389 | A * | 12/1989 | Vidovic | 401/191 |
| 5,028,158 | A | 7/1991 | Fey | |
| 5,382,107 | A * | 1/1995 | Nian | 401/191 |
| 5,464,294 | A * | 11/1995 | Chee et al. | 401/191 |
| 6,238,118 | B1 | 5/2001 | Tryon | |
| 6,241,412 | B1 | 6/2001 | Spies et al. | |
| 6,331,088 | B2 | 12/2001 | Owens | |
| 6,397,859 | B1 | 6/2002 | Byrd | |
| 6,715,952 | B1 | 4/2004 | Aiken et al. | |
| 6,895,976 | B2 | 5/2005 | Hetzler et al. | |
| 6,945,256 | B2 * | 9/2005 | Earl | 401/175 |

FOREIGN PATENT DOCUMENTS

| | | | |
|---|---|---|---|
| EP | 0728428 A1 | * | 8/1996 |
| FR | 2490084 | * | 3/1982 |
| GB | 2085717 A | * | 5/1982 |

* cited by examiner

*Primary Examiner*—Khoa D Huynh
(74) *Attorney, Agent, or Firm*—Taylor & Aust P.C.

(57) ABSTRACT

A self contained disposable toothbrush comprising a reservoir having a threaded end adapted to receive a cap in one of two positions. A brushing assembly is pivoted on the cap so that in a pre-use position the brushing element is positioned along side the reservoir. The brushing element contains bristles and an elongated connecting passage. When the brushing element is pivoted and snapped to the use position where it extends from the reservoir, the passage to the bristles is connected to liquid in the reservoir for moistening a dehydrated dentifrice. When the brushing operation is completed, the cap is unscrewed, the contents of the reservoir used for rinsing and the cap reconnected to the reservoir by a second set of threads such that the brushing element, after use, is contained within the reservoir.

7 Claims, 2 Drawing Sheets

SELF CONTAINED DISPOSABLE TOOTHBRUSH

FIELD OF THE INVENTION

The present invention relates to toothbrushes and more specifically, toothbrushes of the type that are self contained.

BACKGROUND OF THE INVENTION

There have been numerous proposals for self contained toothbrushes that allow a user to use dentifrice to brush their teeth liquid to rinse and dispose of the used components after completing the brushing operation. Problems exist with devices of this type. The first is that there are rather elaborate and bulky mechanisms for connecting the dentifrice, bristles, and reservoirs together in a fashion that can be conveniently used by persons wishing to brush their teeth. The second is when the brushing operation is over, multiple parts must be disposed of. In instances where a storage for parts are provided in the tooth brush, it acts as extra bulk to the container in the disposal condition. This suffers from the disadvantage of being bulkier in a pocket or carrying case until an individual comes to a trash receptacle for appropriate disposal.

SUMMARY OF THE INVENTION

The invention is directed to toothbrush comprising a reservoir for liquid, the reservoir having an open end. A cap is adapted to be removably connected to the open end of the reservoir in first and second positions. A brushing element comprising a stem, head and bristles has a passage through the stem to the bristles. The brushing element is articulated on the cap when the cap is in the first position between a pre-use position where the brushing element is alongside the reservoir and a use position wherein the brushing element extends away from the reservoir and the passage permits limited flow of liquid to the bristles. In a post-use position the cap is in the second position and the brushing element is received within the reservoir.

DESCRIPTION OF SELECTED PREFERRED EMBODIMENTS

Figure 1:
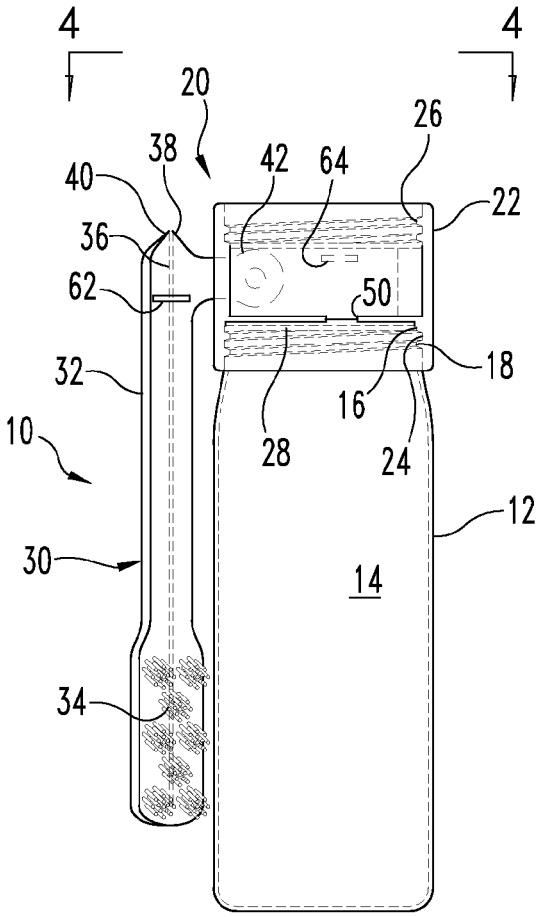
FIG. 1 is a side elevational view of a toothbrush in the pre-use position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein, being contemplated as would normally occur to one skilled in the art to which the invention relates.

FIG. 1 shows a toothbrush 10 comprising a reservoir 12 made from appropriate plastic polymer material such as polypropylene and defining a chamber 14 connected to an opening 16 in the end of reservoir 12. As herein shown, reservoir 12 has external threads 18 at its open end 16. It should be apparent however, to those skilled in the art that the threads may be internal and come in other forms so as to permit the releasable connection of a cap 20 to reservoir 12.

Cap 20 has a straight sided cylindrical outer face 22 having a first set of threads 24, and a second set of threads 26. Threads 24 and 26 as shown herein are inward facing threads and can both engage the threads 18 on reservoir 12 to place the cap 20 in a first position illustrated in FIGS. 1 & 2 or a second position shown in FIG. 3, in which the juxtaposition of the threads 24 and 26 is reversed. In the position illustrated in FIG. 1, with threads 24 engaging threads 18, the chamber 14 is sealed. In addition, a membrane 28 is positioned across the open end 16 of reservoir 12 so as to place it in a pre-assembly sealed position to act as a storage for a liquid such as purified water. It should be apparent that other liquids may be selected to be contained within chamber 14.

Figure 4:
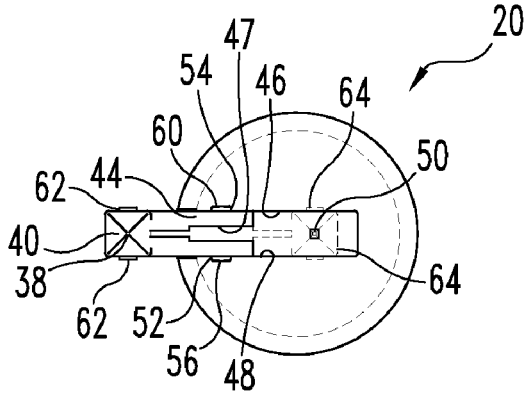
FIG. 4 shows an end-view of the assembly taken on lines 4-4 of FIG. 1.

As shown in FIG. 1, a brushing element 30 comprises a stem 32 and bristles 34 positioned at the end of stem 32. A longitudinal passage 36 extends through stem 32 to an opening 38 in a pointed end 40 of stem 32. Stem 32 has an integral support section 42, extending generally at right angles from stem 32. Support section 42 is received within a slot 44 in cap 20 (see particularly FIG. 4). Slot 44 has opposing generally parallel opposed walls 46 and 48 extending from the cylindrical outer face 22 and beyond an opening 50 in the base of cap 20 so as to expose the center area of membrane 28. Support section 42, and thus stem 32, are articulated in cap 20 by a pivoting arrangement created by a pair of integral journals 52 and 54, which are respectively received within aligned bores 56 and 60 in the opposed walls 48 and 46 respectively. The components can be made out of plastic or other semi flexible material. A longitudinal slot 47 is provided in support section 42 to permit compression of section 42 so that journals 52 & 54 clear walls 48, 46 respectively. When journals 52 & 54 align with bores 56 & 60, the support section 42 is allowed to expand thereby snapping journals 52 and 54 in place. The pointed end 40 of stem 32 is positioned so that when the brush assembly 10 is pivoted from the pre-use position shown in FIG. 1, wherein it is along side the reservoir 12, to the position of FIG. 2 wherein it extends away from reservoir 12, the pointed end 40 extends through an opening 50 to pierce the diaphragm 28 and thus enable a controlled flow of liquid through longitudinal passage 36. As apparent from FIGS. 1 & 2, the moment arm from pointed end 40 to the pivotal axis of the brushing element 30 in journals 52 & 54 is substantially less than the moment arm from the pivotal axis to the bristle area of stem 34. As a result a substantial mechanical advantage is created to force the pointed end 40 through opening 50 and membrane 28. As shown herein the mechanical advantage is about 6 to 1 but other ratios may give similar results. A pair of ribs 62 on the sides of stem 32 snap into corresponding notches 64 on the walls 46 and 48 to lock stem in place in the upright position of FIG. 2.

Figure 2:
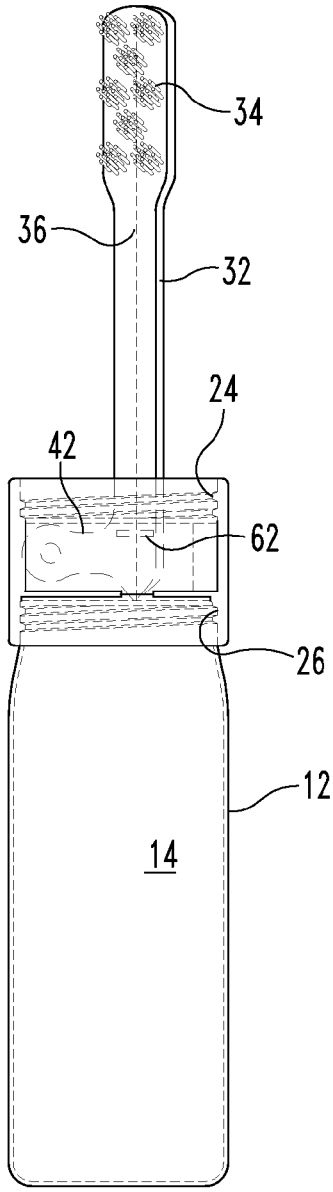
FIG. 2 is a side elevation showing the brush in a use position.

Bristles 34 have an anhydrous dentifrice pre-applied to them so that when the brushing element 10 is pivoted to FIG. 2, a controlled quantity of liquid is permitted to moisten the dentifrice and thus place it in condition for appropriate brushing of the teeth of a user. The passage 36 is selected to have a relatively small cross sectional flow area to limit the amount of water for moistening the dentifrice. The exterior of reservoir 12 acts as a convenient handle to manipulate brushing element 30 and has sufficient girth to be ergonomically comfortable for a user. This continues until the brushing process is finished. At this point, the cap 20 is removed by unscrewing threads 24 and 18 to expose the full quantity of liquid in chamber 14 after removing membrane 8. Thus, a user is able to rinse their mouth to complete the brushing operation.

Figure 3:
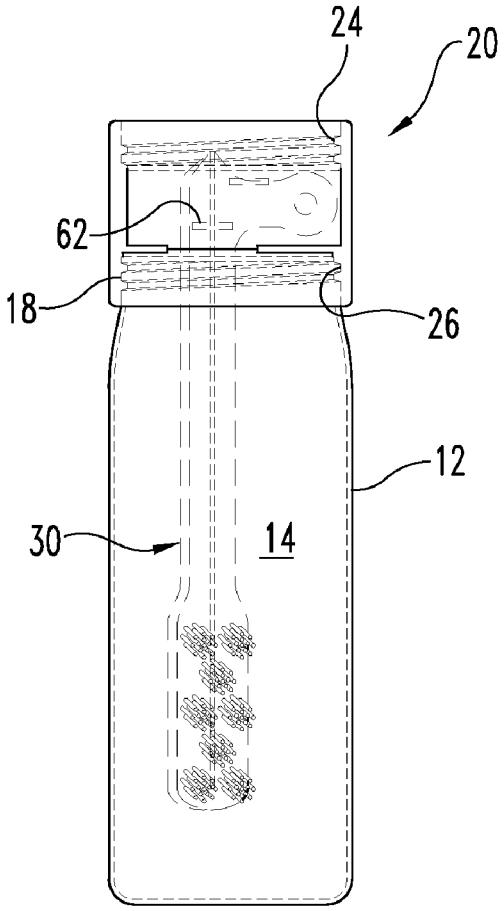
FIG. 3 shows a side elevation of the brush in a post-use position.

At this point when the liquid is no longer in the chamber 14, the cap 20 is reconnected to reservoir 12 in the second position shown in FIG. 3 by engaging threads 26 and 18. Thus it is seen that the brushing element, after use, is compactly contained within the empty reservoir 12 for liquid in the toothbrush 10. The removed membrane may also be placed in reservoir 12, as well as any other accessories like flossing devices and packaging. Thus, the overall envelope of the tooth brush 10 actually decreases after use.

It should be noted that because of the notch 44 the threads 26 are discontinuous due to the need to provide clearance to articulate the brushing element 10 through 180 degrees of movement. However, because the liquid has already been exhausted from chamber 14, the risk of spillage is not a factor.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A toothbrush comprising:

a reservoir for liquid, said reservoir having an open end, said reservoir is covered by a membrane at said open end, a cap removably connected to the open end of said reservoir in a first position and a second position, a brushing element comprising a stem, head and bristles, said brushing element having a passage through said stem to said bristles, said brushing element being articulated on said cap in said first position between a pre-use position wherein said brushing element is positioned alongside said reservoir, a use position wherein said brushing element extends away from said reservoir and said passage permits flow of liquid to said bristles and a post use position wherein said cap is in said second position and said brushing element is received within said reservoir, wherein said brushing element is pivoted on said cap, wherein said brushing element piercing the membrane in the use position to permit controlled flow of liquid to said bristles, wherein said cap has a slot and at least a portion of the stem of said brushing element is received with said slot, said slot having side walls and recesses in opposing walls for receiving journals to permit said brushing element to pivot, wherein one of said stem and said slot has projections and the other recesses to lock the brushing element in said use position, wherein said cap is threaded at both ends, the slot depth in said cap permitting continuous threads for said first position and threads interrupted by said slot in said second position.

2. A toothbrush as claimed in claim 1 wherein said brushing element has a support section extending generally at right angles from said stem, said support section being pivoted on said cap and said passage through said stem terminates at a point the distance from the pivot point on said cap being substantially less than the distance to the bristle end of said stem from said pivot point on said support section thereby providing a mechanical advantage.

3. A tooth brush as claimed in claim 2 wherein said cap has a slot with side walls and opposed aligned recesses for receiving projecting journals on said support section about which said brushing element is pivoted.

4. A tooth brush as claimed in claim 3 wherein said support element has a longitudinal slot permitting said support element to be compressed and cause the projecting journals to clear said slot and snap into the opposed aligned recesses.

5. A toothbrush as claimed in claim 1 wherein said open end of said reservoir is threaded and said cap is threaded at both ends to provide interconnection with said reservoir and said first and second positions.

6. A toothbrush as claimed in claim 5 wherein said reservoir has external threads and said cap has internal threads on both ends.

7. A toothbrush as claimed in claim 1 wherein said bristles contain dehydrated dentifrice.

* * * * *